US012655854B2

(12) United States Patent
Xu et al.

(10) Patent No.: US 12,655,854 B2
(45) Date of Patent: Jun. 16, 2026

(54) FAN COVER

(71) Applicant: ABB SCHWEIZ AG, Baden (CH)

(72) Inventors: Hua Xu, Nantong (CN); Jie Zhang, Nantong (CN); Fabing Li, Shanghai (CN)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 19/244,283

(22) Filed: Jun. 20, 2025

(65) Prior Publication Data

US 2025/0382972 A1 Dec. 18, 2025

Related U.S. Application Data

(63) Continuation of application No. PCT/CN2023/082074, filed on Mar. 17, 2023.

(51) Int. Cl.
*F04D 29/42* (2006.01)
*F04D 29/66* (2006.01)

(52) U.S. Cl.
CPC ..... *F04D 29/424* (2013.01); *F04D 29/664* (2013.01)

(58) Field of Classification Search
None
See application file for complete search history.

(56) References Cited

U.S. PATENT DOCUMENTS 4,733,750 A * 3/1988 Poirier ..... F02B 77/13 181/204
2019/0113044 A1 4/2019 Diehl
2020/0096008 A1 3/2020 Browne et al.

FOREIGN PATENT DOCUMENTS

| | | | |
|---|---|---|---|
| CN | 103840607 | A | 6/2014 |
| CN | 106385136 | A | 2/2017 |
| CN | 109667773 | A | 4/2019 |
| CN | 210669788 | U | 6/2020 |
| CN | 115313761 | A | 11/2022 |
| GB | 2147948 | A | 5/1985 |

OTHER PUBLICATIONS

KR 20090007312 U + machine translation (Year: 2009).*

* cited by examiner

*Primary Examiner* — Juan G Flores
(74) *Attorney, Agent, or Firm* — Greenberg Traurig, LLP

(57) ABSTRACT

Embodiments of the present disclosure provide a fan cover for use with a fan, including a fan chamber, enclosing a space to accommodate the fan; an air chamber, configured to intake air to flow through the fan; and one or more air inlets provided at a sidewall of the air chamber of the fan cover which are used for the flow of the air. Embodiments of the present disclosure also provide a motor comprising a fan for cooling the motor and the fan cover.

16 Claims, 7 Drawing Sheets

FAN COVER

CROSS-REFERENCE TO RELATED APPLICATIONS

This application claims priority to and is a continuation application of international patent application number PCT/CN2023/082074, filed on Mar. 17, 2023, which is herein incorporated by reference in its entirety.

FIELD

Embodiments of the present disclosure generally relate to a fan cover for reducing the noise and temperature rise of the motor.

BACKGROUND

Fans are commonly used to enhance cooling of electrical machines, allowing for increased power density. For example, a motor or a generator may include a fan for cooling the motor or the generator. In general, a fan is installed within a fan cover. For example, a large fan is needed to cool a motor whose temperature may rise during the operation. For decreasing the temperature by a fan, the resulted noise will definitely increase. In the conventional fan cover, the cooling air enters from a non-drive end of the fan cover and blows to the motor after many bends, resulting in high air resistance and low cooling efficiency and leading to high noise and high temperature rise.

Hence, there is a need to propose a fan cover that overcomes the above disadvantages in the art.

SUMMARY

In order to overcome the disadvantages in the prior art, in a first aspect of the present disclosure, a fan cover for use with a fan is provided. The fan cover comprises: a fan chamber, enclosing a space to accommodate the fan; an air chamber, configured to intake air to flow through the fan; and one or more air inlets provided at a sidewall of the air chamber of the fan cover which are used for the flow of the air. By the arrangement of the air inlets, the cooling air enters and blows to the motor after less bends, resulting in low noise and high cooling efficiency.

In some embodiments, the fan cover further comprises a middle partition plate provided between the fan chamber and the air chamber. With these features, the interior of the fan cover can be divided into two function parts.

In some embodiments, the fan cover further comprises an air guide ring configured to extend axially from the middle partition plate. With these features, the flow of the air can be better guided.

In some embodiments, the fan cover further comprises sound isolation foams provided on an interior of the fan cover. By the arrangement of the sound isolation foams, the sound can be absorbed which leads to a low noise.

In some embodiments, the fan cover further comprises one or more stop blocks provided at the air guide ring and configured to fix the sound isolation foams. With these features, the sound isolation foams can be well fixed.

In some embodiments, the fan cover further comprises an end plate detachably mounted at an end of the air chamber. By the arrangement of the end plate, it is easy to conduct the maintenance and replacement of the interior components.

Meanwhile, when there is a need of more air passages for drawing more cooling air, the end plate can form an additional air passage.

In some embodiments, one end of the air guide ring is fixed to the middle partition plate and the other end of the air guide ring is open and at a distance from the end plate, and wherein the air guide ring is hollow. With these features, the flow of the air can be better guided.

In some embodiments, an inner wall of the fan chamber, the middle partition plate, an inner wall of the air chamber, an inner wall of the air guide ring, an outer wall of the air guide ring, the partitions and the end plate are provided with a plurality of stop pins and snap rings for fixing the sound isolation foams. With these features, the sound isolation foams can be well fixed.

In some embodiments, one or more stop pins and snap rings provided at an interior of the fan cover and configured to fix the sound isolation foams to the interior of the fan cover. With these features, the sound isolation foams can be well fixed.

In some embodiments, one or more partitions at the air chamber of the fan cover which extends from the middle partition plate to an end of the fan cover in an axial direction and is connected with the air guide ring, wherein the partitions are configured to divide the air chamber of the fan cover into a plurality of spaces. With these features, there is no annular turbulence produced in the air chamber of the fan cover, the noise is reduced and the cooling efficiency is improved.

In some embodiments, the one or more partitions include an upper partition and a lower partition. With these features, there is no annular turbulence produced in the air chamber of the fan cover, the noise is reduced and the cooling efficiency is improved.

In some embodiments, the fan cover further comprises a mesh provided at each of the one or more air inlets, wherein the mesh is made of metal and configured as a filter screen. With these features, the sound isolation foams are prevented from falling and obstructing the fan.

In some embodiments, the fan cover further comprises another mesh at the inner wall of the fan chamber of the fan cover. With these features, the sound isolation foams are prevented from falling and obstructing the fan.

In some embodiments, a total area of all the air inlets is less than an area of a hollow section of the air guide ring. With these features, the flow of the air can be better guided.

In some embodiments, the fan cover comprises two air inlets at two sides of the sidewall of the fan cover. With these features, the flow of the air can be better guided. And by the arrangement of the air inlets, the cooling air enters and blows to the motor after less bends, resulting in low noise and high cooling efficiency.

In a second aspect of the present disclosure, a motor is provided. The motor comprises a fan for cooling the motor and the fan cover. By the arrangement of the air inlets, the cooling air enters and blows to the motor after less bends, resulting in low noise and high cooling efficiency.

It is to be understood that the Summary is not intended to identify key or essential features of embodiments of the present disclosure, nor is it intended to be used to limit the scope of the present disclosure. Other features of the present disclosure will become easily comprehensible through the description below.

BRIEF DESCRIPTION OF THE DRAWINGS

The above and other objectives, features and advantages of the present disclosure will become more apparent through more detailed depiction of example embodiments of the present disclosure in conjunction with the accompanying drawings, wherein in the example embodiments of the present disclosure, same reference numerals usually represent the same components.

Throughout the drawings, the same or similar reference symbols are used to indicate the same or similar elements.

DETAILED DESCRIPTION

The present disclosure will now be discussed with reference to several example embodiments. It is to be understood these embodiments are discussed only for the purpose of enabling those skilled persons in the art to better understand and thus implement the present disclosure, rather than suggesting any limitations on the scope of the subject matter.

As used herein, the term "comprises" and its variants are to be read as open terms that mean "comprises, but is not limited to." The term "based on" is to be read as "based at least in part on." The term "one embodiment" and "an embodiment" are to be read as "at least one embodiment." The term "another embodiment" is to be read as "at least one other embodiment." The terms "first," "second," and the like may refer to different or same objects. Other definitions, explicit and implicit, may be comprised below. A definition of a term is consistent throughout the description unless the context clearly indicates otherwise.

In the conventional fan cover, the cooling air enters from a non-drive end of the fan cover and blows to the motor after many bends, resulting in high air resistance and low cooling efficiency and leading to high noise and high temperature rise. Embodiments of the present disclosure therefore provide a fan cover that overcomes the above disadvantages in the art.

Figure 1:
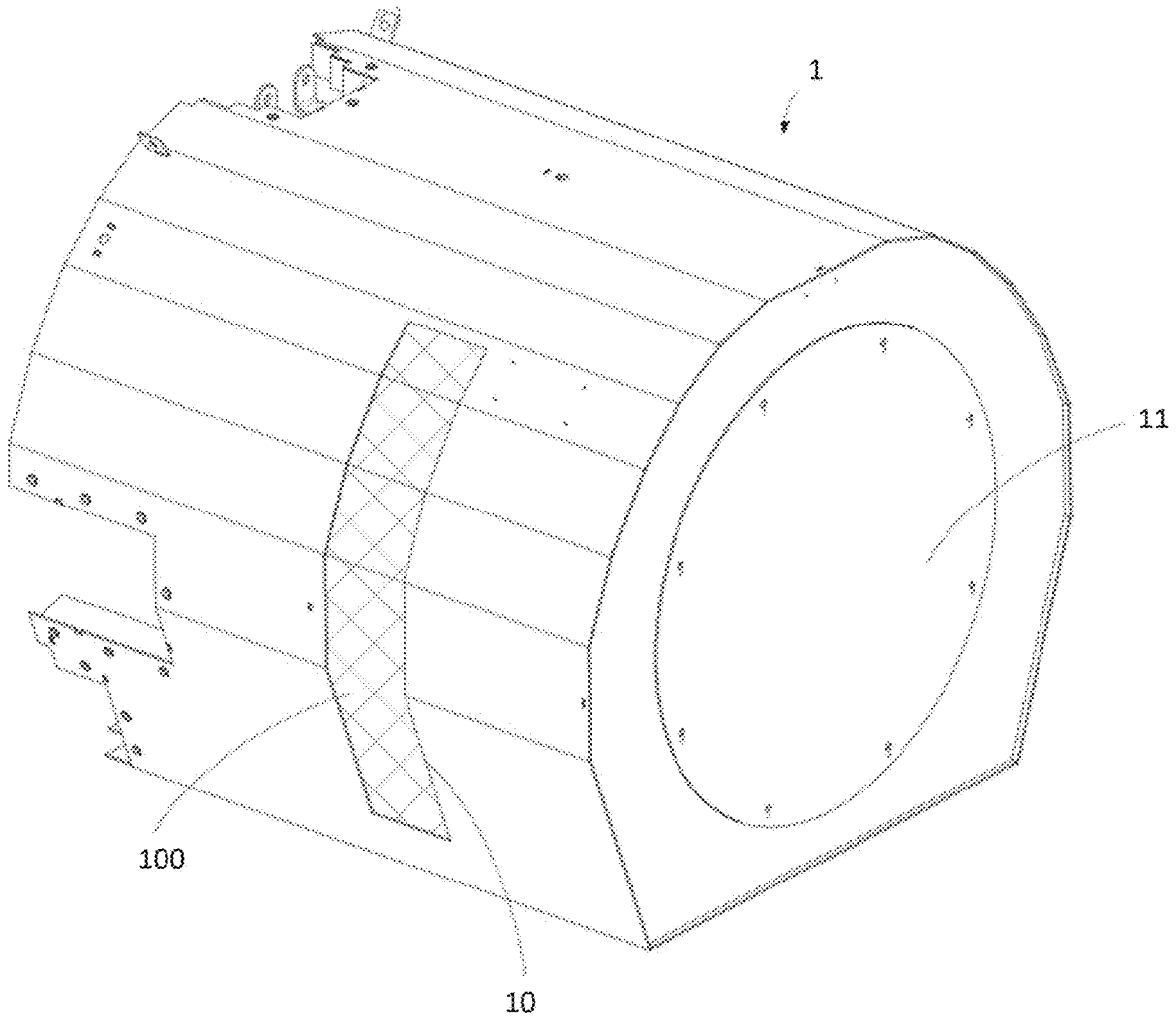
FIG. 1 is a perspective view of a fan cover according to embodiments of the present disclosure.

A motor or a generator may generally include a fan for cooling the motor or the generator and the fan may be housed within a fan cover. FIG. 1 is a perspective view of a fan cover 1 according to embodiments of the present disclosure. The fan cover 1 is used for housing a fan (not shown in FIG. 1). The fan cover 1 has a sidewall and an end portion. The fan cover 1 includes air inlets 10 at the sidewall (only one air inlet is shown in FIG. 1) and an end plate 11 at the end portion. In some embodiments, the fan cover 1 may have one or more air inlets 10. In some embodiments as shown in FIG. 1, the fan cover 1 has two air inlets 10 at two sides of the fan cover. The air inlet 10 is used for inflow of cooling air to cool one or more components to be cooled. A mesh 100 is provided at the air inlet 10. In some embodiments, the mesh 100 is made of metal and used as a filter screen, in which air can flow through the mesh 100 but other objects can be blocked by the mesh 100.

According to embodiments of the present disclosure, one or more air inlets 10 allow air for cooling to enter the interior of the fan cover to cool the components that are to be cooled. The one or more air inlets 10 are provided at the sides of the fan cover, which decreases the noise and improves the cooling efficiency, as discussed in details below.

In some embodiments, the end plate 11 is detachably mounted at an end of the fan cover 1. In FIG. 1, the end plate 11 has circular shape and is mounted at the end of the fan cover 1. The diameter of the circular of the end plate is less than the diameter of an end face of the fan cover. When the end plate is mounted at the end of the fan cover 1, it hermetically closes the end face of the fan cover 1. In other embodiments, the end plate 11 has other shapes, for example, oval.

Figure 2:
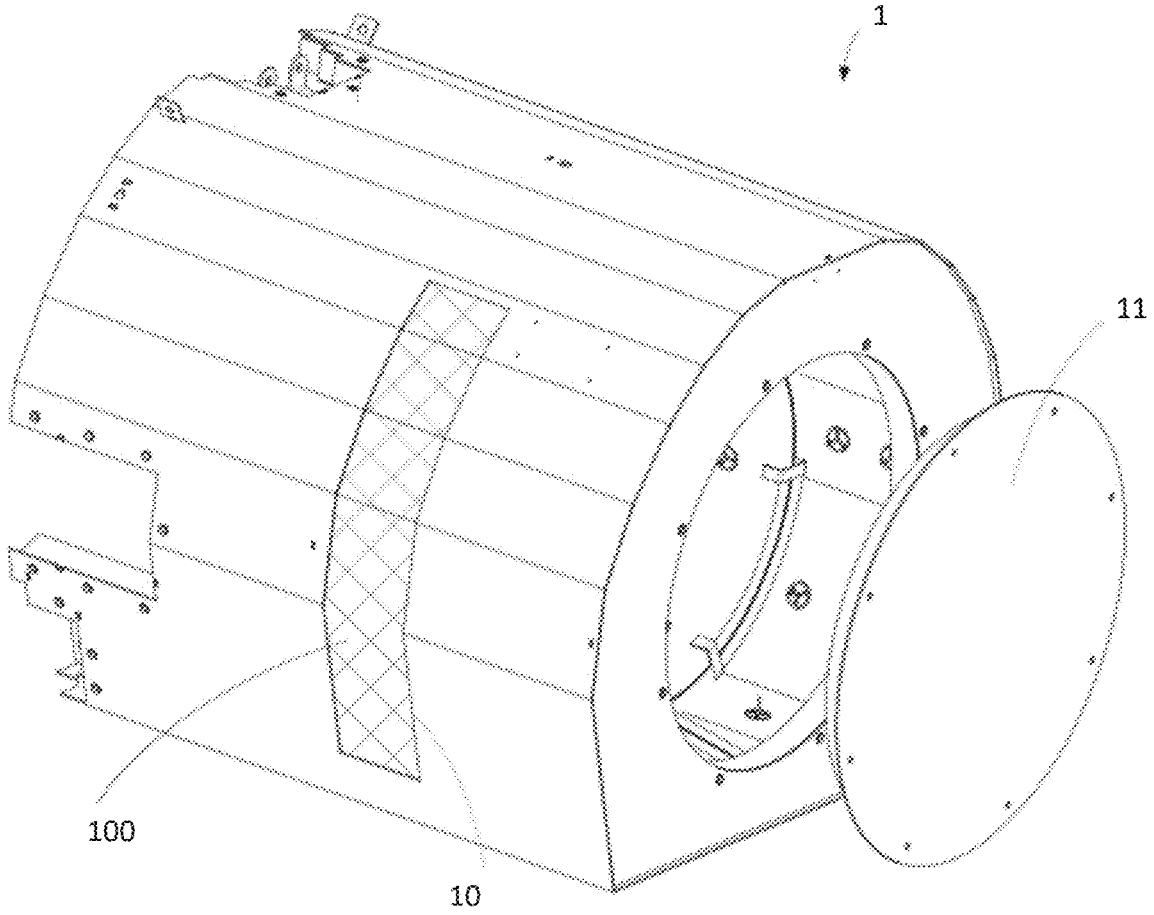
FIG. 2 is a perspective view of a fan cover according to embodiments of the present disclosure.

FIG. 2 is a perspective view of a fan cover according to embodiments of the present disclosure. In FIG. 2, the end plate 11 is removed from the end of the fan cover 1 to show the interior of the fan cover 1. On one hand, when the end plate 11 is removed from the end of the fan cover 1, it allows access to the interior of the fan cover 1 for maintenance and replacement of the interior components. On the other hand, when there is a need of more air passages for drawing more cooling air, the end plate can be removed to form an additional air passage.

Figure 3:
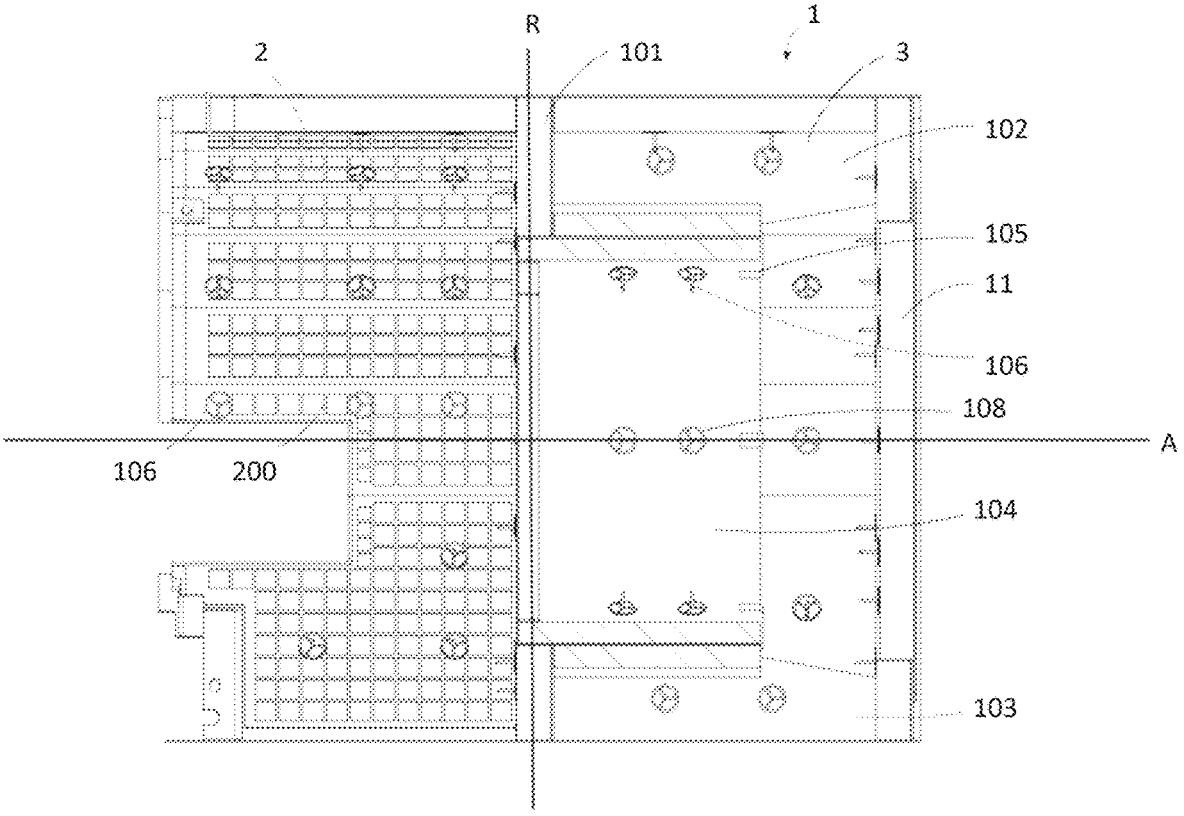
FIG. 3 is a sectional view of a fan cover according to embodiments of the present disclosure.

FIG. 3 is a sectional view of a fan cover 1 according to embodiments of the present disclosure. In FIG. 3, the fan cover 1 has a middle partition plate 101, and the middle partition plate 101 divides the fan cover into two parts: one part is a fan chamber 2 for housing a fan (not shown in FIG. 3) as shown in the left of FIG. 3; the other part is an air chamber 3 for flow of air as shown in the right of FIG. 3. An end of the fan cover is closed by the end plate 11.

Figure 4:
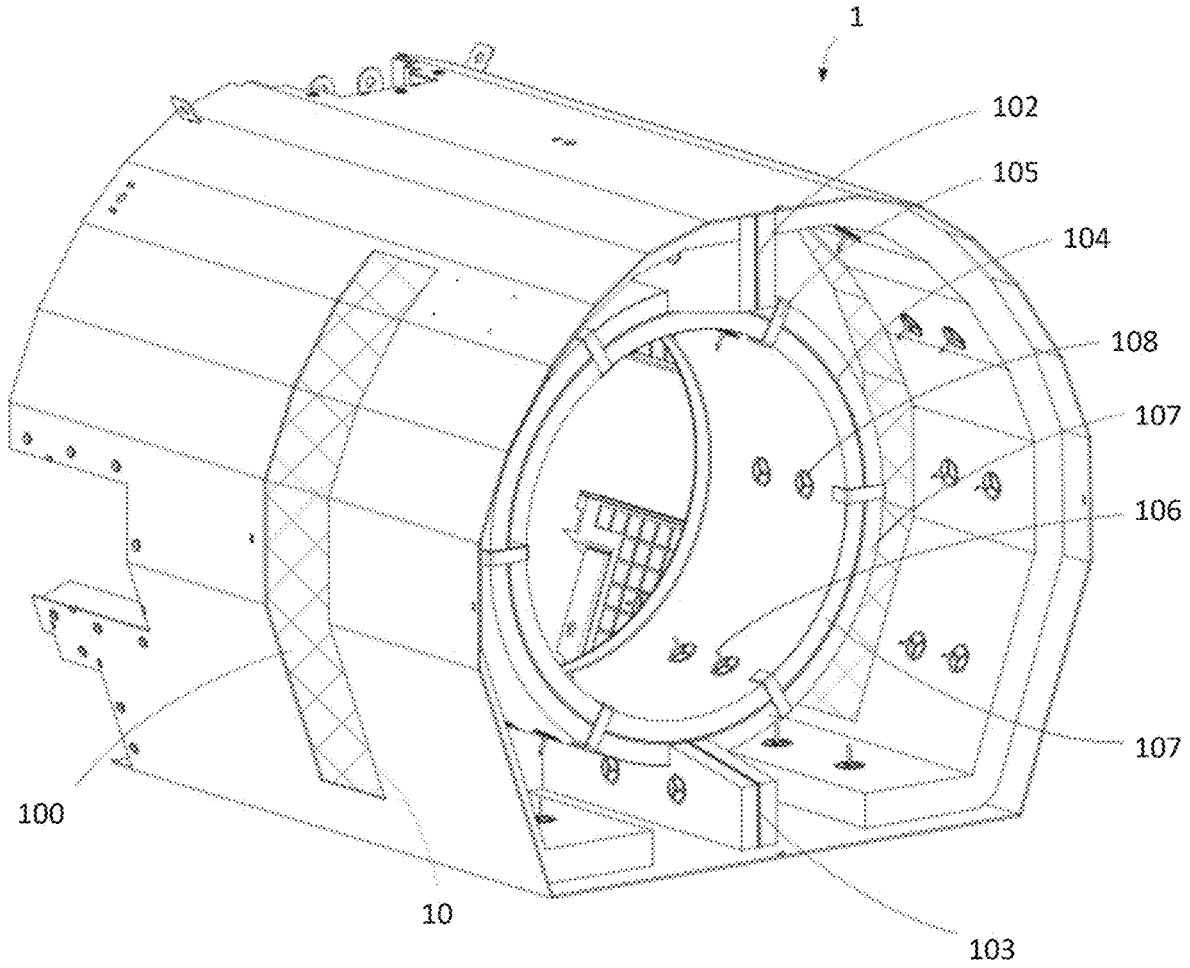
FIG. 4 is a perspective view of a fan cover according to embodiments of the present disclosure.

FIG. 4 is a perspective view of a fan cover according to embodiments of the present disclosure. Referring to FIG. 3 and FIG. 4, the fan cover 1 has an air guide ring 104 extending axially from the middle partition plate 101. In some embodiments, one end of the air guide ring 104 is fixed to the middle partition plate 101. For example, one end of the air guide ring 104 is welded to the middle partition plate 101. In some embodiments, the other end of the air guide ring 104 is open and at a distance from the end plate 11 for directing air. The air guide ring 104 is hollow for flow of air. In some embodiments, the air guide ring 104 is has a cylinder shape.

For decreasing the noise, a sound isolation foam 107 is adhered on the inner wall of the air guide ring 104 and a sound isolation foam 107 is adhered on the outer wall of the air guide ring 104. In some embodiments, one or two ends of the air guide ring 104 are provided with stop blocks 105. For example, one or more stop blocks 105 are welded to one or two ends of the air guide ring 104. In FIG. 4, there are six stop blocks 105 welded at a rim of the air guide ring 104. In other embodiments, other number of stop blocks 105 can be used. The stop blocks 105 are used to fix the sound isolation foams. The air guide ring 104 is also provided with a plurality of stop pins 106 on the inner wall and outer wall of the air guide ring 104. Each stop pin 106 is used together with a snap ring 108 for fixing the sound isolation foams 107. In particular, each stop pin 106 pierces a piece of the sound isolation foam 107 and is snap-fitted and interlocked with a snap ring 108, so that the sound isolation foam 107 is clamped and fixed in position.

As shown in FIG. 4, an upper partition 102 is provided at the air chamber 3 of the fan cover 1 and a lower partition 103 is provided at the air chamber 3 of the fan cover 1. In some embodiments, the upper partition 102 extends from the middle partition plate 101 to the end of the fan cover in an axial direction A. In some embodiments, the upper partition 102 has the same axial length as that of the air chamber 3 of the fan cover 1. The upper partition 102 extends from the inner wall of the air chamber 3 of the fan cover 1 and is connected with the air guide ring 104. In some embodiments, the upper partition 102 has a trapezoidal sectional shape. In other embodiments, the upper partition 102 may have a rectangular sectional shape or other sectional shapes.

As shown in FIG. 4, the lower partition 103 extends from the middle partition plate 101 to the end of the fan cover in an axial direction A. In some embodiments, the lower partition 103 has the same axial length as that of air chamber 3 of the fan cover 1. The lower partition 103 extends from the inner wall of the air chamber 3 of the fan cover 1 and is connected with the air guide ring 104. In some embodiments, the lower partition 103 has a trapezoidal sectional shape. In other embodiments, the lower partition 103 may have a rectangular sectional shape or other sectional shapes.

Figure 5:
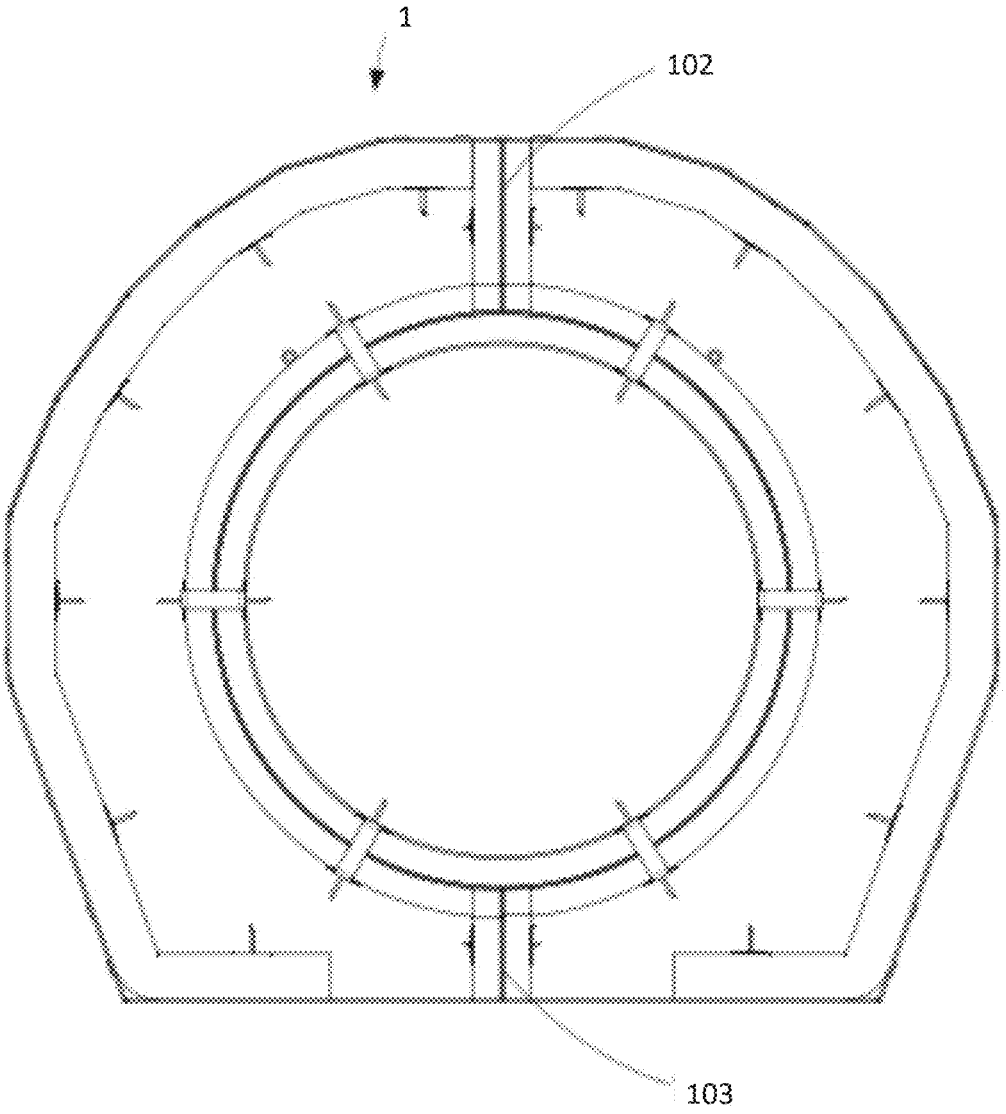
FIG. 5 is a sectional view of a fan cover according to embodiments of the present disclosure.

FIG. 5 is a sectional view of a fan cover according to embodiments of the present disclosure. As shown in FIG. 5, the upper partition 102 and the lower partition 103 divide the air chamber 3 of the fan cover 1 into two spaces: a left space and a right space as shown in FIG. 5. In this way, an annular turbulence can be prevented by the upper partition 102 and the lower partition 103. In the embodiments as shown in FIG. 5, there are two partitions: the upper partition 102 and the lower partition 103. In other embodiments, there are other number of the partitions and other number of the spaces. For example, if there are three, four, five, six . . . partitions, there are three, four, five, six . . . spaces. Since there is no annular turbulence produced in the air chamber of the fan cover, the noise is reduced and the cooling efficiency is improved.

Figure 6:
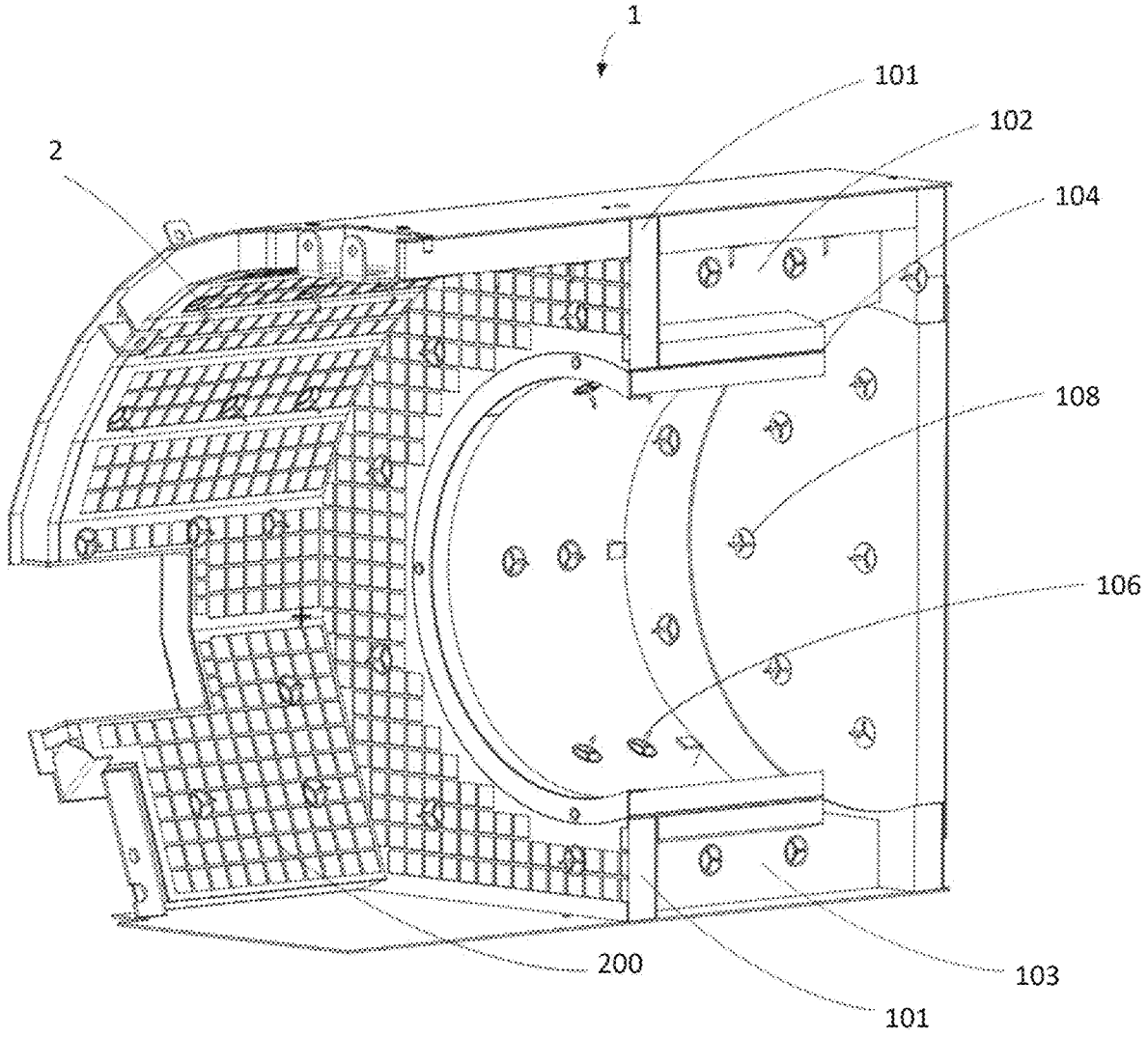
FIG. 6 is a sectional view of a fan cover according to embodiments of the present disclosure.

FIG. 6 is a sectional view of a fan cover according to embodiments of the present disclosure. As shown in FIG. 6, the inner wall of the fan chamber 2 of the fan cover 1 is provided with several stop pins. In addition, a mesh 200 is provided at the inner wall of the fan chamber 2 of the fan cover 1 for preventing the sound isolation foam from falling and obstructing the fan. The mesh 200 may be made of metal. In some embodiments, each stop pin 106 pierces a piece of the sound isolation foam. The mesh 200 is provided outside of the sound isolation foam. And the stop pin 106 is snap-fitted and interlocked with a snap ring 108, so that the sound isolation foam is clamped and fixed in position.

Figure 7:
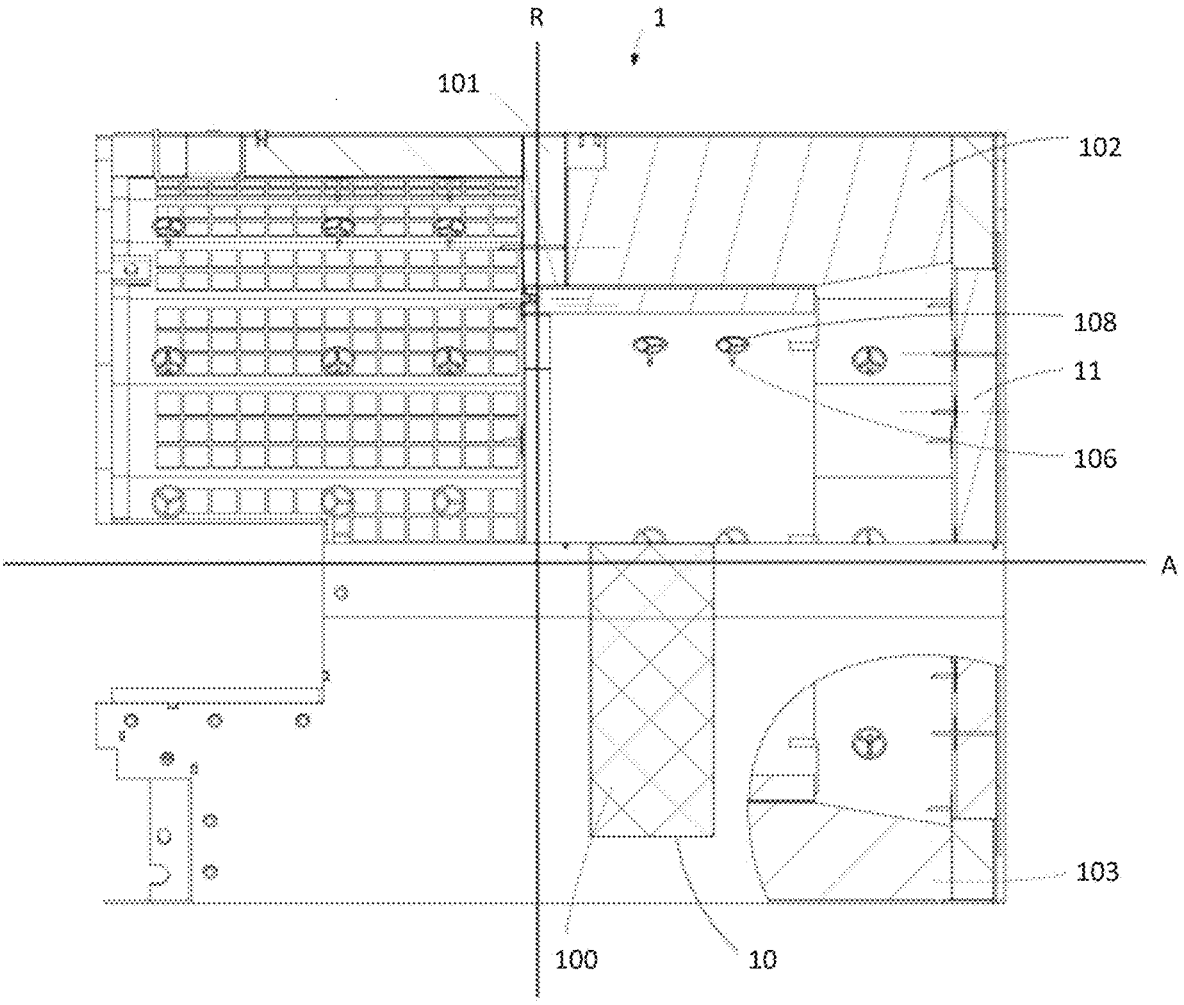
FIG. 7 is a sectional view of a fan cover according to embodiments of the present disclosure.

FIG. 7 is a sectional view of a fan cover 1 according to embodiments of the present disclosure. The fan cover 1 has one or more air inlets 10. The air inlet 10 is located near the middle partition plate 101 in the axial direction A. In some embodiments, the air inlet 10 is located at a position within 70% of a distance from the middle partition plate 101 between the middle partition plate 101 and the end plate 11 in the axial direction A. Preferably, the air inlet 10 is located at a position of 5% to 60% of a distance from the middle partition plate 101 between the middle partition plate 101 and the end plate 11 in the axial direction A. More preferably, the air inlet 10 is located at a position of 10% to 40% of a distance from the middle partition plate 101 between the middle partition plate 101 and the end plate 11 in the axial direction A. Most preferably, the air inlet 10 is located at a position of 15% to 30% of a distance from the middle partition plate 101 between the middle partition plate 101 and the end plate 11 in the axial direction A. In some embodiments, the location of the air inlet can be calculated by the middle line of the air inlet 10 along the radial direction R.

In some embodiments, the air inlet 10 has a rectangle shape on a projection view. In some embodiments, the length of the air inlet along the axial direction A is less than the width of the air inlet along the radial direction R. In some embodiments, the ratio of the length of the air inlet along the axial direction A and the width of the air inlet along the radial direction R is about 1:2 to 1:10. More preferably, the ratio of the length of the air inlet along the axial direction A and the width of the air inlet along the radial direction R is about 1:3 to 1:8. Most preferably, the ratio of the length of the air inlet along the axial direction A and the width of the air inlet along the radial direction R is about 1:4 to 1:6.

In other embodiments, other shapes of the air inlet are possible. The area of the air inlet is calculated by multiplying the length of the air inlet by the width of the air inlet. In some embodiments, there are one or more air inlets, preferably two air inlets. The total area of all the air inlets is less than the area of hollow section of the air guide ring. In some embodiments, two air inlets are located at the same position on two sides and opposite to each other. In other embodiments, two air inlets are located at different positions on two sides and not opposite to each other. In other embodiments, there can be other number of air inlets.

By the arrangement of the air inlets, the cooling air enters and blows to the motor after less bends, resulting in low noise and high cooling efficiency.

As shown in FIG. 3 to FIG. 7, the inner wall of the fan chamber, the middle partition plate, the inner wall of the air chamber, the inner wall of the air guide ring, the outer wall of the air guide ring, the partitions and the end plate are provided with a plurality of stop pins and snap rings. The stop pins and snap rings are used to fix the sound isolation foams. The sound isolation foams are used to absorb the sound and low the noise.

It should be appreciated that the above detailed embodiments of the present disclosure are only for exemplifying or explaining principles of the present disclosure and do not limit the present disclosure. Therefore, any modifications, equivalent alternatives and improvements, etc. without departing from the spirit and scope of the present disclosure shall be comprised in the scope of protection of the present disclosure. Meanwhile, appended claims of the present disclosure aim to cover all the variations and modifications falling under the scope and boundary of the claims or equivalents of the scope and boundary.

What is claimed is:

1. A fan cover for use with a fan, comprising:
a fan chamber, enclosing a space to accommodate the fan;
an air chamber, configured to intake air to flow through the fan;
one or more air inlets provided at a sidewall of the air chamber of the fan cover which are used for the flow of the air; and
one or more partitions at the air chamber of the fan cover which extends from a middle partition plate to an end of the fan cover in an axial direction and is connected with an air guide ring, wherein the one or more partitions are configured to divide the air chamber of the fan cover into a plurality of spaces.

2. The fan cover of claim 1,
wherein the middle partition plate is provided between the fan chamber and the air chamber.

3. The fan cover of claim 2,
wherein the air guide ring is configured to extend axially from the middle partition plate.

4. The fan cover of claim 1, further comprising:
sound isolation foams provided on an interior of the fan cover.

5. The fan cover of claim 4, further comprising:

one or more stop blocks provided at the air guide ring and configured to fix the sound isolation foams.

6. The fan cover of claim 4, further comprising:

an end plate detachably mounted at an end of the air chamber.

7. The fan cover of claim 6, wherein one end of the air guide ring is fixed to the middle partition plate and an other end of the air guide ring is open and at a distance from the end plate, and wherein the air guide ring is hollow.

8. The fan cover of claim 6, wherein an inner wall of the fan chamber, the middle partition plate, an inner wall of the air chamber, an inner wall of the air guide ring, an outer wall of the air guide ring, the one or more partitions and the end plate are provided with a plurality of stop pins and snap rings for fixing the sound isolation foams.

9. The fan cover of claim 1, further comprising:

one or more stop pins and snap rings provided at an interior of the fan cover and configured to fix sound isolation foams to the interior of the fan cover.

10. The fan cover of claim 1, wherein the one or more partitions include an upper partition and a lower partition.

11. The fan cover of claim 1, further comprising:

a mesh provided at each of the one or more air inlets, wherein the mesh is made of metal and configured as a filter screen.

12. The fan cover of claim 1, further comprising:

another mesh at an inner wall of the fan chamber of the fan cover.

13. The fan cover of claim 1, wherein a total area of all the one or more air inlets is less than an area of a hollow section of the air guide ring.

14. The fan cover of claim 1, wherein the fan cover comprises two air inlets at two sides of the fan cover.

15. A motor, comprising:

a fan for cooling the motor; and the fan cover of claim 1.

16. A fan cover for use with a fan, comprising:

a fan chamber, enclosing a space to accommodate the fan;

an air chamber, configured to intake air to flow through the fan;

one or more air inlets provided at a sidewall of the air chamber of the fan cover which are used for the flow of the air;

sound isolation foams provided on an interior of the fan cover; and an end plate detachably mounted at an end of the air chamber, wherein an inner wall of the fan chamber, a middle partition plate, an inner wall of the air chamber, an inner wall of an air guide ring, an outer wall of the air guide ring, partitions, and the end plate are provided with a plurality of stop pins and snap rings for fixing the sound isolation foams.

* * * * *